US010927318B2

(12) United States Patent
Koseoglu et al.

(10) Patent No.: US 10,927,318 B2
(45) **Date of Patent: *Feb. 23, 2021**

(54) LUBRICITY ADDITIVE FOR TRANSPORTATION FUELS

(71) Applicant: Saudi Arabian Oil Company, Dhahran (SA)

(72) Inventors: Omer Refa Koseoglu, Dhahran (SA); Robert Peter Hodgkins, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 4 days.

This patent is subject to a terminal disclaimer.

(21) Appl. No.: 16/210,445

(22) Filed: Dec. 5, 2018

(65) Prior Publication Data

US 2020/0181517 A1 Jun. 11, 2020

(51) Int. Cl.

| | |
|---|---|
| ***C10L 10/08*** | (2006.01) |
| ***C10L 1/24*** | (2006.01) |
| ***C10M 135/10*** | (2006.01) |
| *C10N 30/06* | (2006.01) |

(52) U.S. Cl.

CPC ..... *C10L 10/08* (2013.01); *C10L 1/2437* (2013.01); *C10M 135/10* (2013.01); *C10L 2200/0446* (2013.01); *C10M 2219/044* (2013.01); *C10N 2030/06* (2013.01)

(58) Field of Classification Search

CPC ... C07C 317/04; C07C 315/02; C07C 319/30; C07C 7/10; C10G 53/14; C10G 27/10; C10M 135/10; C10M 2219/044; C10N 2030/06; C10L 10/08; C10L 1/2431;

(Continued)

(56) References Cited

U.S. PATENT DOCUMENTS 2,433,395 A * 12/1947 Shoemaker ..... B01J 27/00 562/118

2,489,316 A 11/1949 Proell (Continued)

FOREIGN PATENT DOCUMENTS

CN 101940872 A 1/2011
WO 2006/016374 A1 2/2006

(Continued)

OTHER PUBLICATIONS

Engel et al., Remove mercaptans from hydrocarbon condensates and NGL streams, pp. 1-6, Feb. 2016.*

(Continued)

*Primary Examiner* — Vishal V Vasisth

(74) *Attorney, Agent, or Firm* — Abelman, Frayne & Schwab

(57) ABSTRACT

Oxidized disulfide oil (ODSO) compounds, derived from by-product disulfide oil (DSO) compounds from the MEROX process, are effective as lubricity additives for transportation fuels. Significant increases in lubricity of ultra-low sulfur fuels as measured by the WSD test were observed with addition of ODSO compounds in the range of from 0.1 ppmw to 10 ppmw. This use of ODSO compounds as lubricity additives converts an otherwise DSO waste oil product into a valuable commodity that has utility in improving lubricity properties of transportation fuels.

14 Claims, 3 Drawing Sheets

(58) Field of Classification Search
CPC ..... C10L 1/2437; C10L 2270/023; C10L 2270/026; C10L 2200/0446
See application file for complete search history.

(56) References Cited

U.S. PATENT DOCUMENTS

| | | | | |
|---|---|---|---|---|
| 2,677,617 | A * | 5/1954 | Thompson | C08K 5/41 426/547 |
| 2,697,722 | A | 12/1954 | Johnson et al. | |
| 3,513,088 | A | 5/1970 | Karabinos et al. | |
| 4,992,578 | A * | 2/1991 | Husain | C07C 381/04 560/307 |
| 6,132,590 | A | 10/2000 | Moran et al. | |
| 9,580,661 | B2 | 2/2017 | Koseoglu | |
| 2002/0151570 | A1* | 10/2002 | Kretschik | C07D 317/18 514/345 |
| 2006/0254930 | A1 | 11/2006 | Martinie et al. | |
| 2014/0323562 | A1 | 10/2014 | Jessop et al. | |

FOREIGN PATENT DOCUMENTS

| | | | |
|---|---|---|---|
| WO | 2015085522 | A1 | 6/2015 |
| WO | 2015086424 | A1 | 6/2015 |

OTHER PUBLICATIONS

Cantau et al., Oxidation of nauseous sulfur compounds by photocatalysis or photosensitization, Catalysis Today, vol. 122, 2007, 12 pages.
International Search Report and Written Opinion dated Feb. 10, 2020 in counterpart International Application PCCT/US2019/063812 filed Nov. 28, 2109.
Lancombe et al., "Oxysulfur Compounds Derived From Dimethyl Disulfide: An ab Initio Study", Journal of Organic Chemistry, Nov. 10, 1997, vol. 63, No. 7, pp. 2281-2291.
Li et al., "Experimental Study on Deep Desulfurization of MTBE by Electrochemical Oxidation and Distillation", RSC Advances, Jan. 1, 2016, vol. 6, No. 6, pp. 4803-4809.
Xu et al., "Preparation Method of Xanthate Ester and its Application in Antifouling Paint", Faming Zhuanli Shenqing, 7PP, Jun. 29, 2018, (Abstract only), Chemical Abstracts Service.
Drabowicz et al., "Product Class 1: Alkanesulfonic Acids and Acrylic Derivatives", Science of Synthesis, 2007, vol. 39, pp. 17-122, (Abstract only), Chemical Abstracts Service.

* cited by examiner

LUBRICITY ADDITIVE FOR TRANSPORTATION FUELS

BACKGROUND OF THE INVENTION

Field of the Invention

This invention relates to lubricity additives for transportation fuels.

Description of Related Art

It is known in the art that the lubricity of transportation fuels such as diesel and gasoline is reduced as a result of desulfurization processes that are required to meet regulatory requirements. This is especially so when the sulfur levels of the fuels are reduced to ultra-low levels, e.g., less than 15 ppmw. Increased severity of hydrotreatment, e.g, hydrodesulfurization and hydrodenitrogenation, produces ultra-low sulfur fuels with unacceptably low lubricity properties. In addition to removing sulfur and nitrogen compounds, oxygen compounds which also contribute to lubricity, are removed during the hydrotreating process. During hydrotreatment, polar compounds having lubricating qualities are also removed and the lubricity of the hydrotreated transportation fuel is decreased substantially.

The reduction of transportation fuel lubricity received attention in the early 1990s. At that time, Sweden introduced ultra-low sulfur fuels on a commercial scale, identified as Swedish Class 1 & Swedish Class 2 Fuels. The commercialization of ultra-low sulfur fuels with less than 15 ppmw of sulfur was a great achievement for the refining industry. However, this milestone coincided with an increased number of automotive failures.

The number of incidents of cold-starting problems and fuel injection pump failures reported were increasing. Some reported failures occurred in passenger cars after only 3,000 to 10,000 km following the initiation of continuous use of the ultra-low sulfur diesel and gasoline fuels. Investigations into the lubricity of ultra-low sulfur diesel fuels expanded and automotive engine manufacturers now specify a minimum lubricity requirement for the fuels.

The lubricity of diesel fuels is essential to the long-term reliable operation of rotatory diesel fuel injection pumps. These high contact and high friction fuel injection pumps are lubricated primarily by the fuel itself. Prior to the introduction of low sulfur fuels, viscosity measurements were used as an indicator of the ability of the fuel to provide wear protection. However, after the introduction of low sulfur fuels, even some high viscosity fuels were unable to provide the necessary anti-friction wear protection. Various standards and methods of measuring ultra-low sulfur gasoline and diesel fuel lubricity have been developed and applied to directly assess the wear-protection ability of fuels.

Fuel lubricity can be determined experimentally by one of several standard methods. The High Frequency Reciprocating Rig (HFRR) test method ASTM D6079 for diesel fuel lubricity is a commonly used method for evaluating the lubricity of a diesel fuel. The ASTM D4863 test method is a commonly used method for evaluating the lubricity of a gasoline. The HFRR method is designed to evaluate boundary lubrication properties of diesel fuels. The HFRR test is a microprocessor-controlled test that measures a wear scar resulting from a reciprocating frictional motion, in which a 2-mL fuel sample is tested in each run. The fuel sample is placed in a recess in a standard metal test plate and a test ball is attached to an arm and is brought into contact with the test plate submerged in the fuel sample. Additional loading is applied to the test ball before starting the reciprocating motion. The wear scar produced on the ball as a result of the oscillating contact between the test ball and the test plate takes the form of a flattened circular area the diameter of which is measured using a microscope equipped with a digital camera.

In Europe, the United States and many other countries, the requirement for the fuel lubricity measurement for diesel is a wear scar diameter (WSD) no greater than 460 nm. The HFRR method has a high reproducibility of +60 μm.

The lubricating capability of petroleum fuels is generally attributed to the presence of organic compounds containing oxygen, nitrogen, and sulfur. These compounds are believed to form a boundary layer on the high contact metal surfaces of engines and thus affect lubricity.

Studies have been carried out to quantify the effect of oxygen, nitrogen and sulfur compounds on the lubricity of diesel fuels in which model oxygen, nitrogen and sulfur compounds are reintroduced into the ultra-low sulfur diesel (ULSD) fuels. Surprisingly, it was observed that reintroducing sulfur compounds into ULSD had little effect on the lubricity of the modified fuel.

In contrast, it has been shown that the introduction of some nitrogen compounds do improve the lubricity of ULSD fuels. For example, introducing 8-hydroxyquoniline into a ULSD fuel provided the greatest improvement among other additives tested in one particular study (Matzke, M., Litzow, U., Jess, A., Caprotti, R. et al., "Diesel Lubricity Requirements of Future Fuel Injection Equipment," SAE Int. J. Fuels Lubr. 2(1):273-286, 2009).

The literature includes reports on other studies that have investigated various additives for lubricity improvement. The reported additives have mainly been oxygen compounds, such as, acids and esters, but they also have included nitrogen, for example, amides. The effect of blending bio-diesels that are rich in oxygen compounds on the lubricity of diesel fuels has shown an improvement in the lubricity characteristics of the blended diesel fuel. FIG. 1 illustrates the effect of the indicated additives on diesel fuel lubricity as measured by the ASTM standard HFRR test, where the lower test values indicate enhanced lubricity. This data shows that without any addition, the wear scar diameter (WSD) far exceeded the 460 μm limit, and that of these test additives, oxygenated compounds produced the greatest improvement in the lubricity of the transportation fuel as measured by the WSD.

A need exists for a lubricity additive for transportation fuels that is highly effective at low levels of addition, reasonably priced and therefore cost-effective, and readily available in locations were transportation fuels are blended.

SUMMARY OF THE INVENTION

In accordance with the present disclosure, it has been found that oxidized disulfide oil (ODSO) compounds are effective as lubricity additives for transportation fuels. Significant increases in lubricity of ultra-low sulfur fuels as measured by the WSD test were observed with addition of ODSO compounds in the range of from 0.1 ppmw to 10 ppmw.

By-product disulfide oil (DSO) compounds from the mercaptan oxidation process, commonly referred to as the "MEROX" process, when oxidized, preferably in the presence of a catalyst have been found to constitute an abundant source of the ODSO compounds that are oil-soluble sulfoxides, sulfonates, and sulfones at working conditions, i.e., at an additive concentration in the range of from 0.1 ppmw to 10 ppmw.

On a global basis, MEROX mercaptan oxidation units are commonly found in refineries and the disulfides generated are blended with fuel oil or processed in hydrotreating or hydrocracking process units or injected into the ground to dispose them. When the disulfides are added to fuel oil, they are typically burned to produce steam or provide other utilities. This use can raise environmental concerns where the combustion gases with sulfur-containing constituents are emitted in the refinery. The disulfides may undergo hydroprocessing, but hydroprocessing is not a favorable method for disposal of waste oil because additional hydrogen is required and will be consumed.

Thus, this use of ODSO compounds as lubricity additives for transportation fuels converts an otherwise DSO waste oil product into a valuable commodity that has utility in improving lubricity properties of transportation fuels.

Table 1 includes examples of ODSO compounds produced in the oxidation of the DSO compounds derived from the MEROX sulfur reduction or sweetening process.

TABLE 1

| ODSO Compounds | | |
|---|---|---|
| ODSO Name | Formula | Structure Examples |
| Dialkyl-thio-sulfoxide or alkyl-alkane-sulfino-thioate | (R—SO—S—R) | 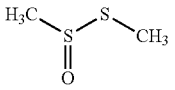 S-Methyl methane-sulfinothioate |
| Dialkyl-thio-sulfones or Alkyl-Alkane-thiosulfonate | (R—SOO—S—R) | 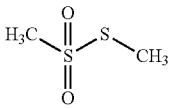 Methyl Methane-thiosulfonate |
| Dialkyl-sulfone-sulfoxide Or 1,2-alkyl-alkyl-di-sulfane 1,1,2-trioxide | (R—SOO—SO—R) | 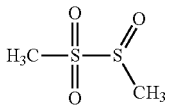 1,2-Dimethyl-disulfane 1,1,2-trioxide |
| Dialkyl-di-sulfone Or 1,2 alkyl-alkyl-di-sulfane 1,1,2,2-tetraoxide | (R—SOO—SOO—R) | 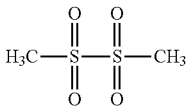 1,2-Dimethyldi-sulfane 1,1,2,2-tetraoxide |
| Dialkyl-di-sulfoxide | (R—SO—SO—R) | 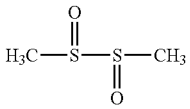 1,2-Dimethyl-disulfane 1,2-dioxide |

TABLE 1-continued

| ODSO Compounds | | |
|---|---|---|
| ODSO Name | Formula | Structure Examples |
| Alkyl-sulfoxide-sulfonate | (R—SO—SOO—OH) | 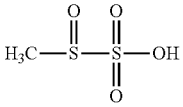 Methylsulfane-sulfonic acid oxide |
| Alkyl-sulfone-sulfonate | (R—SOO—SOO—OH) | 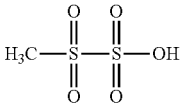 1-Hydroxy-2-methyldisulfane 1,1,2,2-tetraoxide |
| Alkyl-sulfoxide-sulfinate | (R—SO—SO—OH) | 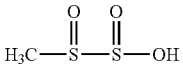 1-Hydroxy-2-methyldisulfane 1,2-dioxide |
| Alkyl-sulfone-sulfinate | (R—SOO—SO—OH) | 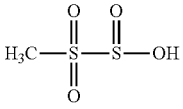 Methylsulfane-sulfinic acid dioxide |

Table 1 includes ODSO compounds that are polar and water-soluble, and also those that are non-polar and water insoluble. ODSO compounds that contain 1 and 2 oxygen atoms are non-polar and water insoluble. ODSO compounds that contain 3 or more oxygen atoms are water-soluble. The production of either polar or non-polar ODSO compounds is in part dependent on the reaction conditions during the oxidation process.

The water soluble compounds that contain 3 or more oxygen atoms are water soluble over all concentrations and are also oil soluble at relatively low concentrations in the range of from 0.1 ppmw to 10 ppmw.

Both water soluble ODSO compounds and water insoluble ODSO compounds are beneficial as lubricity additives. In preferred embodiments, water soluble, i.e., polar, compounds are used. These water soluble ODSO compounds are added at the lower concentrations where they are also soluble in oil, i.e., at a concentration in the range of from 0.1 ppmw to 10 ppmw. Water soluble ODSO compounds are more efficient as lubricity additives because of the presence of more oxygen atoms in the structure and because the overall percent by weight of sulfur in the compounds decreases with an increase in oxygen atoms.

The oxidized disulfide oils from the enhanced MEROX process are highly effective as lubricity additives in transportation fuels.

In preferred embodiments, the amount of ODSO compounds added to the fuel is in the range of from 0.1 ppmw to 10 ppmw. In certain embodiments, the ODSO compounds are added at a concentration in the range of from 0.1 ppmw to 5 ppmw, 1 ppmw to 10 ppmw, or 1 ppmw to 5 ppmw.

The disulfide oils having the general formula RSSR produced in the MEROX process can be oxidized without or with one or more catalysts to produce an oxidized disulfide oil (ODSO) for use as lubricity additives in accordance with the present disclosure. If a catalyst is used in the oxidation of the disulfide oils (RSSR) to produce the oxidized disulfide oil (ODSO), it can be a heterogeneous or homogeneous oxidation catalyst. The oxidation catalyst can be selected from one or more heterogeneous or homogeneous catalyst comprising metals from the IUPAC Group 4-12 of the Periodic Table, including Ti, V, Mn, Co, Fe, Cr, Cu, Zn, W and Mo. In certain embodiments, suitable homogeneous catalysts include molybdenum naphthanate, sodium tungstate, molybdenum hexacarbonyl, tungsten hexacarbonyl, sodium tungstate and vanadium pentaoxide. In certain embodiments, suitable heterogeneous catalysts include Ti. V, Mn, Co, Fe, Cr, W, Mo, and combinations thereof deposited on a support such as alumina, silica-alumina, silica, natural zeolites, synthetic zeolites, and combinations comprising one or more of the above supports. A preferred catalyst is sodium tungstate, $Na_2WO_4 \cdot 2H_2O$. A suitable product is commercially available from, e.g., Sigma-Alrich Co. LLC.

In this description, the terms "lubricity additive", "additive" and "ODSO compound(s)" are used interchangeably.

Sources of ODSO Compounds

It is known in the art that the presence of mercaptans in petroleum products are undesirable because of their unpleasant odor and corrosivity and also because they degrade the stability of end-product fuels. Processes in oil refineries and natural gas processing plants that remove mercaptans and/or hydrogen sulfide ($H_2S$) are commonly referred to as sweetening processes because they result in products which no longer have the sour, foul odors of mercaptans and hydrogen sulfide. The liquid hydrocarbon disulfides can remain in the sweetened end products; or they can be used as part of the petroleum refinery or natural gas processing plant fuel; or they can be subjected to further downstream processing.

The MEROX designation is derived from the mercaptan oxidation step of the process. The MEROX process is a proprietary catalytic mercaptan oxidation process widely used in petroleum refineries and natural gas processing plants to remove mercaptans contained in end-products such as LPG, propane, butanes, light naphtha, kerosene and jet fuel by converting them into liquid hydrocarbon disulfides. It is an integrated process comprising the mercaptan extraction step in which mercaptans react with an aqueous caustic solution in the presence of a catalyst to form an alkylthiolate with a base, which is then oxidized in a wet air oxidation step to produce disulfide oils and a regenerated caustic solution that is recycled to the extraction step. The alkaline environment required in some versions of the practice of the MEROX process is provided by an aqueous solution of sodium hydroxide (NaOH), a strong base, or in other versions of the process, by ammonia, which is a relatively weaker base than sodium hydroxide, but also volatile and must be handled with special care due to its irritant and toxicity properties.

The stepwise reaction schemes for the MEROX process beginning with the treatment of the mercaptan are as follows:

$$2RSH+2NaOH \rightarrow 2NaSR+2H_2O \quad (1)$$

In the above reaction, RSH is a mercaptan and R is an organic group such as a methyl, ethyl, propyl or other hydrocarbon group. For example, the ethyl mercaptan (ethanethiol) has the formula $C_2H_5SH$.

The catalyst used in some versions of the MEROX process is a water-soluble liquid and in other versions the catalyst is impregnated onto charcoal granules. The catalyst used in the MEROX process can be an organometallic compound.

The second step is referred to as regeneration and it involves heating and oxidizing the caustic solution leaving the extractor. The oxidation results in converting the extracted mercaptans to organic disulfides (RSSR). These disulfides are water-insoluble liquids that are separated and decanted from the aqueous caustic solution. The regeneration reaction scheme is as follows:

$$4NaSR+O_2+2H_2O \rightarrow 2RSSR+4NaOH \quad (2)$$

In reactions (1) and (2), R is methyl or a hydrocarbon chain that may be straight, branched or cyclic. The R chains may be saturated or unsaturated. In most petroleum and diesel fractions, mixtures of mercaptans will occur such that the R groups in the disulfide oil (RSSR) can be the same or different groups.

The liquid disulfides created by the conversion of the mercaptans do not have these undesirable characteristics and have been retained in the MEROX treated fuels or removed and used elsewhere in the petroleum refinery. The MEROX process is generally more economical than a catalytic hydrodesulfurization process and achieves much the same result of the conversion of mercaptans. Economic and practical drawbacks associated with hydrodesulfurization processes include higher capital expenditures and operating costs.

The oxidation to produce the OSDO can be carried out in an oxidation reaction vessel operating at a pressure in the range from about 1 bar to about 30 bars, in certain embodiments from about 1 bar to about 10 bars, and in further embodiments from about 1 bar to about 3 bars, and at a temperature of about 20° C. to 300° C., in certain embodiments about 20° C. to 150° C. and in further embodiments about 45° C. to 60° C. The molar feed ratio of oxidizing agent-to-sulfur can be in the range of from about 1:1 to about 100:1, in certain embodiments from about 1:1 to about 30:1, and in further embodiments from about 1:1 to about 4:1. The residence time in the reaction vessel can be in the range of from about 5 to 180 minutes, in certain embodiments from about 15 to 90 minutes and in further embodiments from about 15 minutes to 30 minutes.

BRIEF DESCRIPTION OF THE DRAWINGS

The process of this disclosure will be described in more detail below and with reference to the attached figures in which.

DETAILED DESCRIPTION OF THE INVENTION

Figure 1:
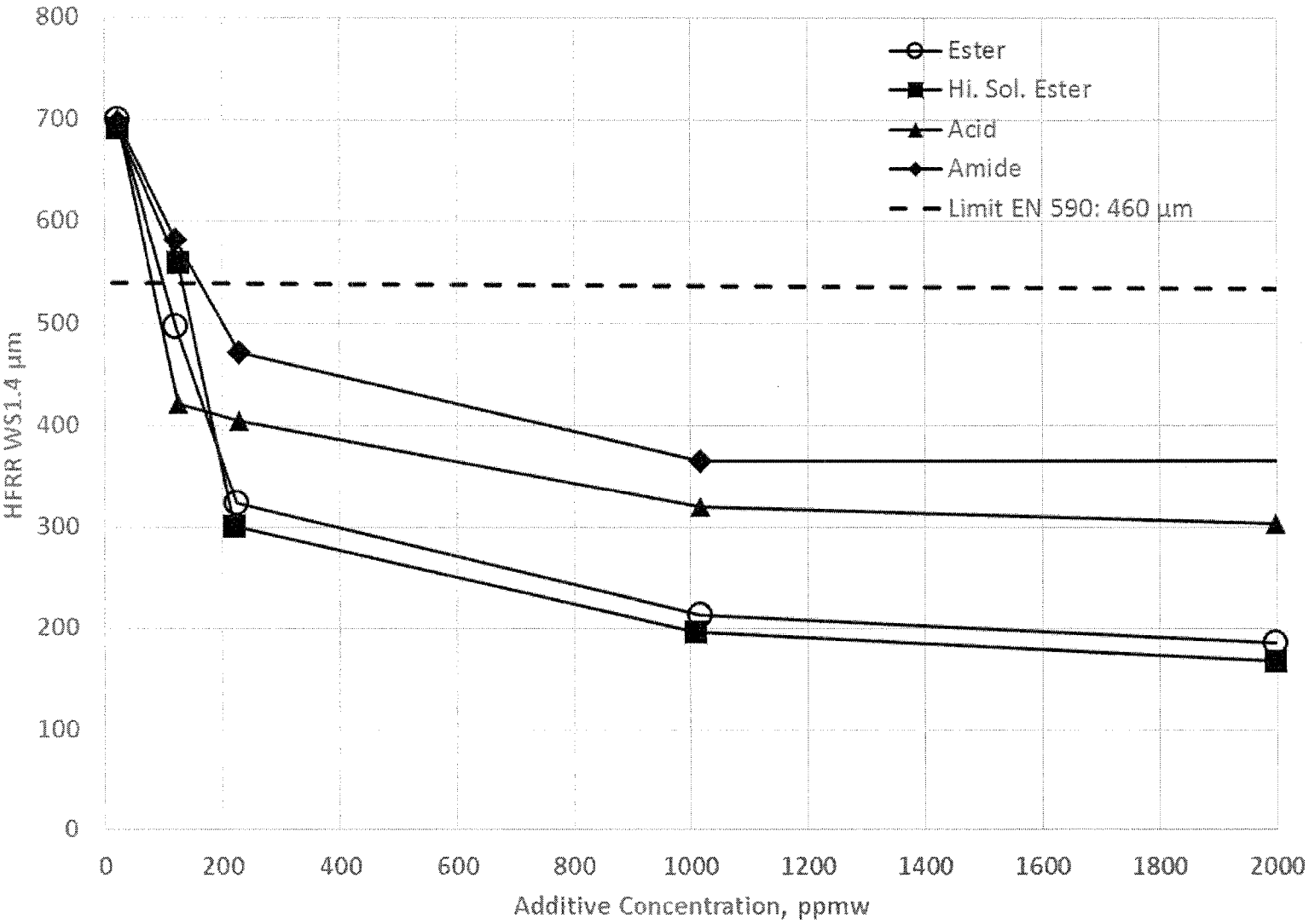
FIG. 1 PRIOR ART
FIG. 1 is a graph illustrating the effect of various types of commercial additives of the prior art on the lubricity of an ultra-low sulfur diesel fuel.

The lubricity of transportation fuels such as diesel and gasoline are selectively improved by the addition of specified oxidized disulfide oil (ODSO) compounds. In certain embodiments, the transportation fuel has a sulfur level less than 150 ppmw, in preferred embodiments a sulfur level in the range of from 1 to 150 ppmw, and in more preferred embodiments a sulfur level in the range of from 1-5 ppmw. Compounds found to have utility as lubricity additives can advantageously be produced by the oxidation of disulfide oil (DSO) compounds recovered as a low value by-product of the catalyzed mercaptan oxidation of a hydrocarbon feedstock, commonly referred to as the MEROX process.

The lubricity additive can be mixed directly with the transportation fuel, or doped with a portion of the fuel for convenience and to facilitate its mixing, to provide a fuel with improved lubricity properties.

The lubricity additive can be pre-mixed with n-hexane or other solvent that is compatible with the fuel in order to facilitate its addition to, and uniform blending with the fuel to obtain the desired concentration of the additive in fuel.

In a preferred embodiment, the number of carbon atoms in the ODSO lubricity additive is in the range of from 2 to 20. In certain embodiments, the number of carbon atoms in the ODSO lubricity additive is in the range of from 1 to 20, 1 to 10, or 2 to 10.

The ODSO lubricity additives of the present disclosure are soluble in oil at the working concentrations. The water soluble ODSO compounds have a boiling point in the range of from 20° C. to 650° C. The water insoluble ODSO compounds have a boiling point in the range of from 20° C. to 250° C. In preferred embodiments, the lubricity additives contain alkyl groups with carbon numbers in the range of from 1 to 20. In certain embodiments, the lubricity additives contain alkyl groups with carbon numbers in the range of from 1 to 10. In preferred embodiments, each alkyl group has a carbon number in the range of from 1 to 3.

EXAMPLES

The ASTM D6079 HFRR test method for diesel fuel lubricity was applied in the following examples to determine the lubricity of the fuel and additive mixture.

Example 1

Two gas oils derived from light and medium crude oils were used as feedstocks to test the lubricity improvements with the additives. The gas oils were first hydrotreated in a pilot plant using various methods and conditions known to those skilled in the art to obtain ultra-low sulfur diesel. The composition and properties of the gas oils before hydrotreating are shown in Table 3.

TABLE 3

Composition and Properties of Gas oils before Hydrotreating

| Diesel | Unit | Diesel 1 | Diesel 2 |
|---|---|---|---|
| API Gravity | ° | 0.8222 | 0.8432 |
| sulfur | ppmw | 8901 | 13090 |
| nitrogen | ppmw | 49 | 71 |
| Simulated Distillation | | | |
| Initial B.P./5/10 W % | ° C. | 84/131/160 | 141/188/204 |
| 30/50 W % | ° C. | 217/262 | 249/286 |
| 70/90 W % | ° C. | 305/351 | 319/351 |
| 95 W %/Final B.P. | ° C. | 367/391 | 364/400 |

The gas oils were hydrotreated at a hydrogen partial pressure of 33 bars, LHSV of 1.5 $h^{-1}$ and at a temperature in the range of from 320° C. to 355° C. The product gas oils contained sulfur in the range of from 5-777 ppmw.

Figure 2:
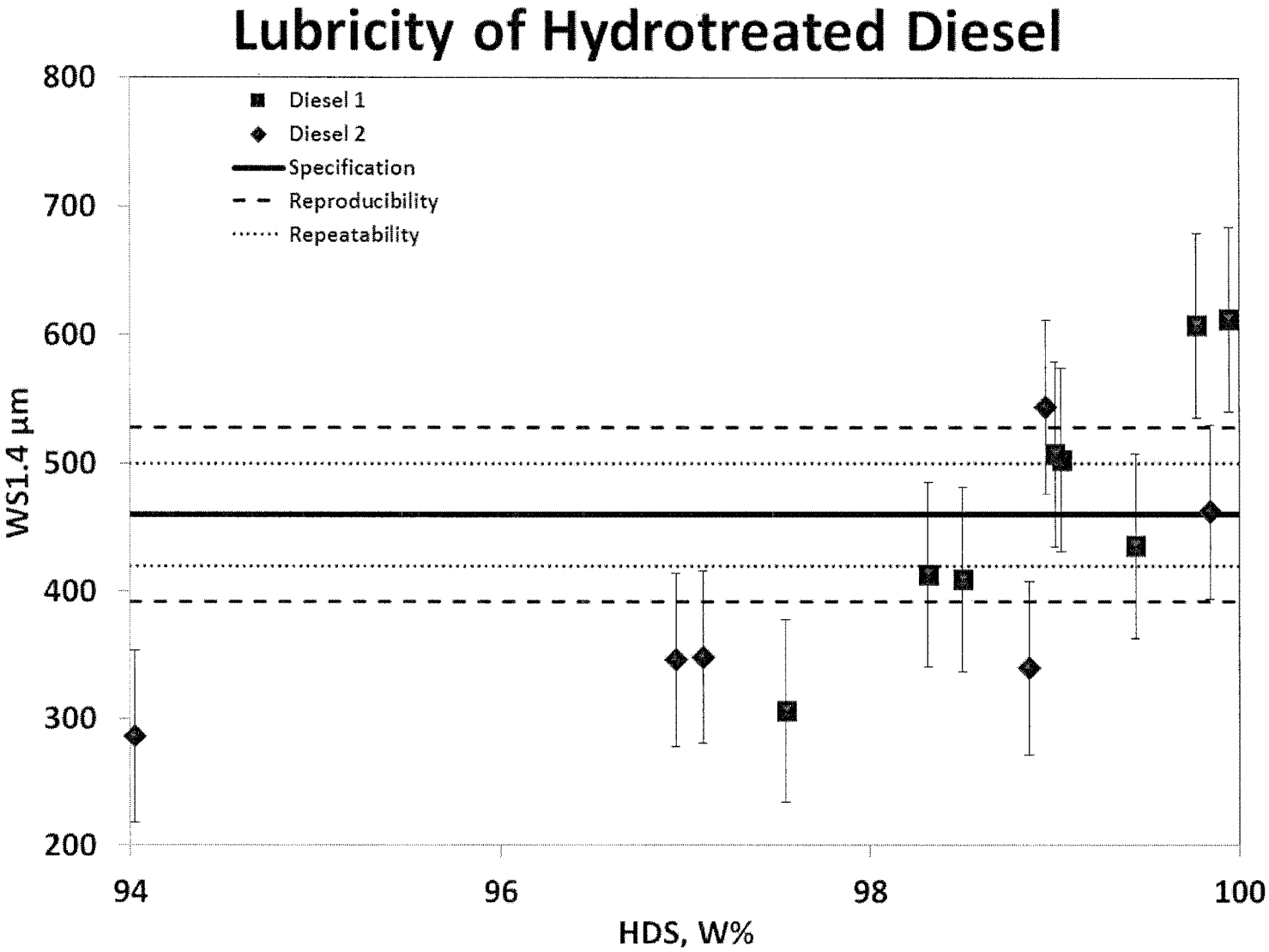
FIG. 2 PRIOR ART
FIG. 2 is a graph illustrating the lubricity of hydrotreated diesels of the prior art as a function of the level of hydrodesulfurization.

FIG. 2 shows the effect on the lubricity of the diesel fuels tested as a function of the percent completion of hydrodesulfurization measured along the x-axis. It is clear that the lubricity level of the fuel decreased as the percent completion of the hydrodesulfurization process approached the theoretical value of 100%. It is clear that there were unacceptable lubricity characteristics (a WSD of more than 460 μm) in the fuels with higher levels of completion of hydrodesulfurization.

Figure 3:
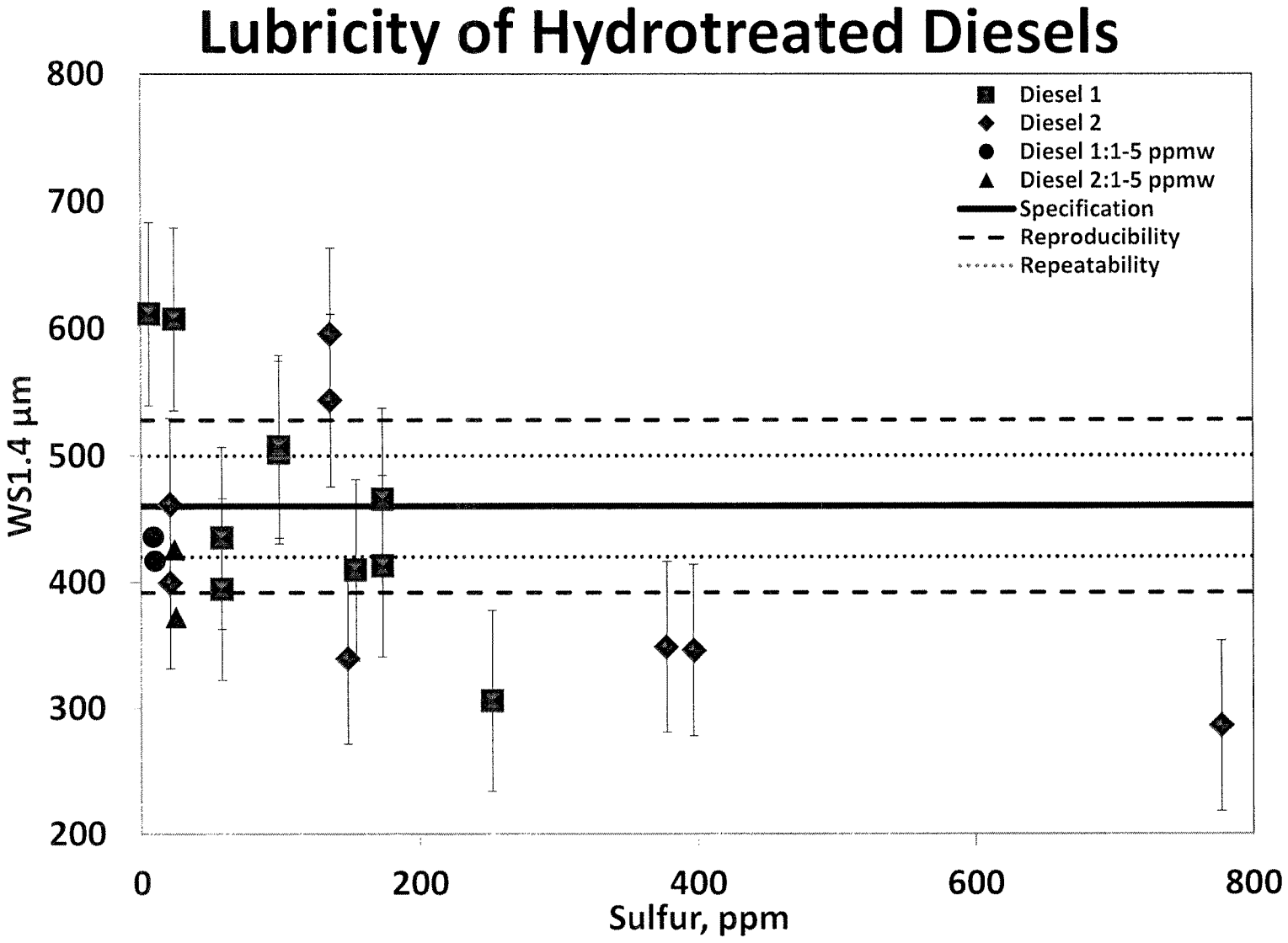
FIG. 3 is a graph illustrating the lubricity of hydrotreated diesel-range fuels as a function of sulfur concentration.

FIG. 3 illustrates the lubricity of the hydrotreated diesels as a function of sulfur content. For untreated fuel samples, Diesel 1 (■) and Diesel 2(♦), respectively, the diesel lubricity decreased with reduced sulfur level in the diesels, resulting in an increase in WSD levels. It is clear that there were unacceptable lubricity characteristics, i.e., a WSD of more than 460 μm, in the fuels with sulfur levels of less than 150 ppm by weight for untreated diesels. For diesels treated with the lubricity additive, (●) and (▲) in FIG. 3, there is an improvement in lubricity and that the fuel and additive mixture has acceptable lubricity characteristics, i.e., a WSD of less than 460 μm.

Table 4 shows the compositions and properties of the two hydrotreated diesel samples with the lowest sulfur amounts, i.e., 6 and 21 ppmw, respectively.

TABLE 4

Composition and Properties of Gas oil samples after Hydrotreating

| Diesel | Unit | Hydrotreated Diesel 1 | Hydrotreated Diesel 2 |
|---|---|---|---|
| API Gravity | ° | 0.8139 | 0.8274 |
| sulfur | ppmw | 6 | 21 |
| nitrogen | ppmw | 3 | 4 |
| Simulated Distillation | | | |
| Initial B.P./5/10W % | ° C. | 86/139/163 | 135/187/202 |
| 30/50 W % | ° C. | 215/256 | 245/278 |
| 70/90 W % | ° C. | 297/344 | 311/348 |
| 95 W %/Final B.P. | ° C. | 362/392 | 361/397 |

Each of the diesel samples were mixed with the ODSO additive compounds at a concentration in the range of from 1.0 ppmw to 5.0 ppmw. Table 5 shows the effect of the ODSO additive on the lubricity of the diesels.

TABLE 5

Lubricity of diesels mixed with ODSO additive

| Diesel Source | ODSO lubricity additive, ppmw | WSD, μm | WSD Delta, Improvements, μm |
|---|---|---|---|
| Diesel 1 | 0.0 | 532 | — |
| Diesel 1 | 1.0 | 375 | 157 |
| Diesel 1 | 4.0 | 436 | 96 |
| Diesel 1 | 5.0 | 417 | 115 |
| Diesel 2 | 0.0 | 504 | — |
| Diesel 2 | 1.0 | 390 | 114 |
| Diesel 2 | 4.0 | 426 | 78 |
| Diesel 2 | 5.0 | 373 | 131 |

It is clear from Table 5 that the presence of ODSO additives in the fuels tested improved their respective lubricities. As indicated by the data, no direct correlation was observed between the degree of improved lubricity and the concentration of the ODSO additive. Even at the lower concentrations of 1 ppmw of additive, the lubricity of the fuel was improved.

The methods and compositions of the present invention have been described in detail above and in the attached drawings; however, modifications will be apparent to those of ordinary skill in the art from this description and the scope of protection for the invention is to be determined by the claims that follow.

We claim:

1. A lubricity additive for improving the lubricity of a transportation fuel that is an oxidized disulfide oil (ODSO) compound selected from the group consisting of (R—SO—S—R'), (R—SOO—S—R'), (R—SOO—SO—R'), (R—SOO—SOO—R'), (R—SO—SO—R'), (R—SO—SOO—OH), (R—SOO—SOO—OH), (R—SO—SO—OH), and (R—SOO—SO—OH), and mixtures thereof, where R and R' are alkyl groups comprising 1-10 carbon atoms, wherein the ODSO compounds correspond to oxidized disulfide oils present in an effluent refinery hydrocarbon stream recovered following the catalytic oxidation of mercaptans present in a petroleum feedstream.

2. The lubricity additive of claim 1, in which the number of carbon atoms in the lubricity additive compounds is in the range of from 1 to 20.

3. The lubricity additive of claim 1, in which the number of carbon atoms in the lubricity additive compounds is in the range of from 2 to 20.

4. The lubricity additive of claim 1, wherein the additive has at least 3 oxygen atoms.

5. The lubricity additive of claim 1, wherein the WSD value for the transportation fuel as determined by ASTM D-6079 is reduced by at least 60 μm.

6. A transportation fuel that contains one or more of the lubricity additives of claim 1.

7. The transportation fuel of claim 6 which is diesel fuel.

8. A method of improving the lubricity of an ultra-low sulfur gasoline or diesel transportation fuel that comprises adding to the fuel at least one of the compounds of claim 1.

9. The method of claim 8, wherein the additive is present in fuel in the range of from 0.1 to 10 ppmw of the fuel.

10. The method of claim 8, wherein the fuel contains at least 1 ppmw of the additive.

11. The method of claim 8, wherein the lubricity additive is mixed with a fuel having a sulfur concentration that is not greater than 150 ppmw.

12. The method of claim 8 in which the transportation fuel is diesel.

13. A transportation fuel composition that includes a lubricity additive that is a mixture of ODSO compounds that comprises two or more of the following:

(R—SO—S— R'), (R—SOO—S— R'), (R—SOO—SO—R'), (R—SOO—SOO—R'), (R—SO—SO—R'), (R—SO—SOO—OH), (R—SOO—SOO—OH), (R—SO—SO—OH), and (R—SOO—SO—OH) and mixtures thereof, where R and R' are alkyl groups comprising 1-10 carbon atoms, wherein the ODSO compounds correspond to oxidized disulfide oils present in an effluent refinery hydrocarbon stream recovered following the catalytic oxidation of mercaptans present in a petroleum feedstream.

14. The composition of claim 13, where the transportation fuel is a low or ultra-low sulfur diesel.

* * * * *